US007704038B2

(12) United States Patent
Ring et al.

(10) Patent No.: US 7,704,038 B2
(45) Date of Patent: Apr. 27, 2010

(54) METHOD AND APPARATUS TO FACILITATE REDUCING LOSSES IN TURBINE ENGINES

(75) Inventors: Matthew Joseph Ring, New York, NY (US); Samuel Rulli, Gloucester, MA (US); Cory Kirk, Memphis, TN (US); Hsin-Tuan Liu, West Chester, OH (US); Apostolos Karafillis, Arlington, MA (US)

(73) Assignee: General Electric Company, Schenectady, NY (US)

( * ) Notice: Subject to any disclaimer, the term of this patent is extended or adjusted under 35 U.S.C. 154(b) by 725 days.

(21) Appl. No.: 11/564,027

(22) Filed: Nov. 28, 2006

(65) Prior Publication Data

US 2008/0120841 A1 May 29, 2008

(51) Int. Cl.
*F01D 25/28* (2006.01)

(52) U.S. Cl. ..... 415/112; 415/214.1

(58) Field of Classification Search ..... 415/214.1, 415/112, 177, 178, 232, 213.1
See application file for complete search history.

(56) References Cited

U.S. PATENT DOCUMENTS 4,190,397 A 2/1980 Schilling et al.
4,883,407 A 11/1989 Touze
5,090,865 A 2/1992 Ramachandran et al.
5,161,565 A 11/1992 Jamieson
5,259,725 A * 11/1993 Hemmelgarn et al. .... 415/214.1
6,442,941 B1 9/2002 Anand et al.
6,543,234 B2 4/2003 Anand et al.
7,094,020 B2 8/2006 Dong et al.
2006/0193721 A1 * 8/2006 Adam et al. ..... 415/177

* cited by examiner

*Primary Examiner*—Richard Edgar
(74) *Attorney, Agent, or Firm*—William Scott Andes, Esq.; Armstrong Teasdale LLP

(57) ABSTRACT

A method for assembling a compressor for use with a turbine is provided. The method includes coupling at least a first stator ring to a second stator ring via at least one fastener sized to extend through at least one stator ring opening. The method further includes coupling a shield assembly to at least one of the first stator ring and the second stator ring to facilitate reducing convection and aerodynamic bleed losses of the at least one stator ring. The shield assembly includes a downstream surface, a retaining portion, and a contoured upstream surface extending from the downstream surface to the retaining portion.

17 Claims, 6 Drawing Sheets

METHOD AND APPARATUS TO FACILITATE REDUCING LOSSES IN TURBINE ENGINES

BACKGROUND OF THE INVENTION

This invention relates generally to turbine engines, and more particularly to methods and apparatus for reducing convection and aerodynamic bleed losses in turbine engines.

The efficiency of at least some known turbines is at least partially affected by the clearances defined between the rotating components and stationary components. Specifically, the magnitude of steady state clearances and transient radial clearances between the components may affect the turbine efficiency and/or operability margin. For example, a large transient clearance, or a clearance with significant variation around the circumference of the rotating component may adversely decrease the turbine efficiency and may result in engine stalls.

As described above, clearances may be affected by the rotor and the stator's transient thermal responses. Generally, known stators are built to be as lightweight as possible to meet engine weight metrics. This low stator weight makes the stator's transient thermal response typically faster than that of known rotors. Since the stator expands faster than the rotor, rotor tip clearances may increase transiently. Known stator assemblies include a plurality of stator rings coupled together. Specifically, such stator rings are coupled to each other with fasteners which extend through flanges, spaced about the outer circumference of the stator rings. To facilitate slowing the transient thermal response of the stator rings, at least some known turbine assemblies include U-shaped shields that cover the flanges. The shields accomplish this by reducing the convective film coefficients of the stator rings such that the stator rings experience a slower temperature-displacement response.

However, because such U-shaped shields are positioned adjacent the flowpath, the shields may adversely impact engine efficiency, specifically, such shields may increase aerodynamic losses associated with the compressor bleed flow. In some known compressors, aerodynamic losses are incurred because of windage, convection, and/or pressure losses due to the discharge of the air flow in a large cavity and the turbulence of the flow associated therewith.

BRIEF DESCRIPTION OF THE INVENTION

In one aspect a method for assembling a compressor for use with a turbine is provided. The method includes coupling at least a first stator ring to a second stator ring via at least one fastener sized to extend through at least one stator ring opening. The method further includes coupling a shield assembly to at least one of the first stator ring and the second stator ring to facilitate reducing convection and aerodynamic bleed losses of the at least one stator ring. The shield assembly includes a downstream surface, a retaining portion, and a contoured upstream surface extending from the downstream surface to the retaining portion.

In another aspect, a turbine assembly is provided. The turbine assembly includes a compressor assembly including at least one flange coupled to at least one stator ring via at least one fastener sized to extend through at least one stator ring opening. The turbine assembly further includes a shield assembly coupled to the at least one stator ring to facilitate reducing convection and aerodynamic bleed losses of the at least one stator ring. The shield assembly includes a downstream surface, a retaining portion, and a contoured upstream surface extending from the downstream surface to the retaining portion.

In a further aspect, a compressor assembly for use with a turbine is provided. The compressor assembly includes at least one flange coupled to at least one stator ring via at least one fastener sized to extend through at least one stator ring opening. The compressor assembly further includes a shield assembly coupled to the at least one stator ring to facilitate reducing convection and aerodynamic bleed losses of said at least one stator ring. The shield assembly comprises a downstream surface, a retaining portion, and a contoured upstream surface extending from the downstream surface to the retaining portion.

DETAILED DESCRIPTION OF THE INVENTION

Figure 1:
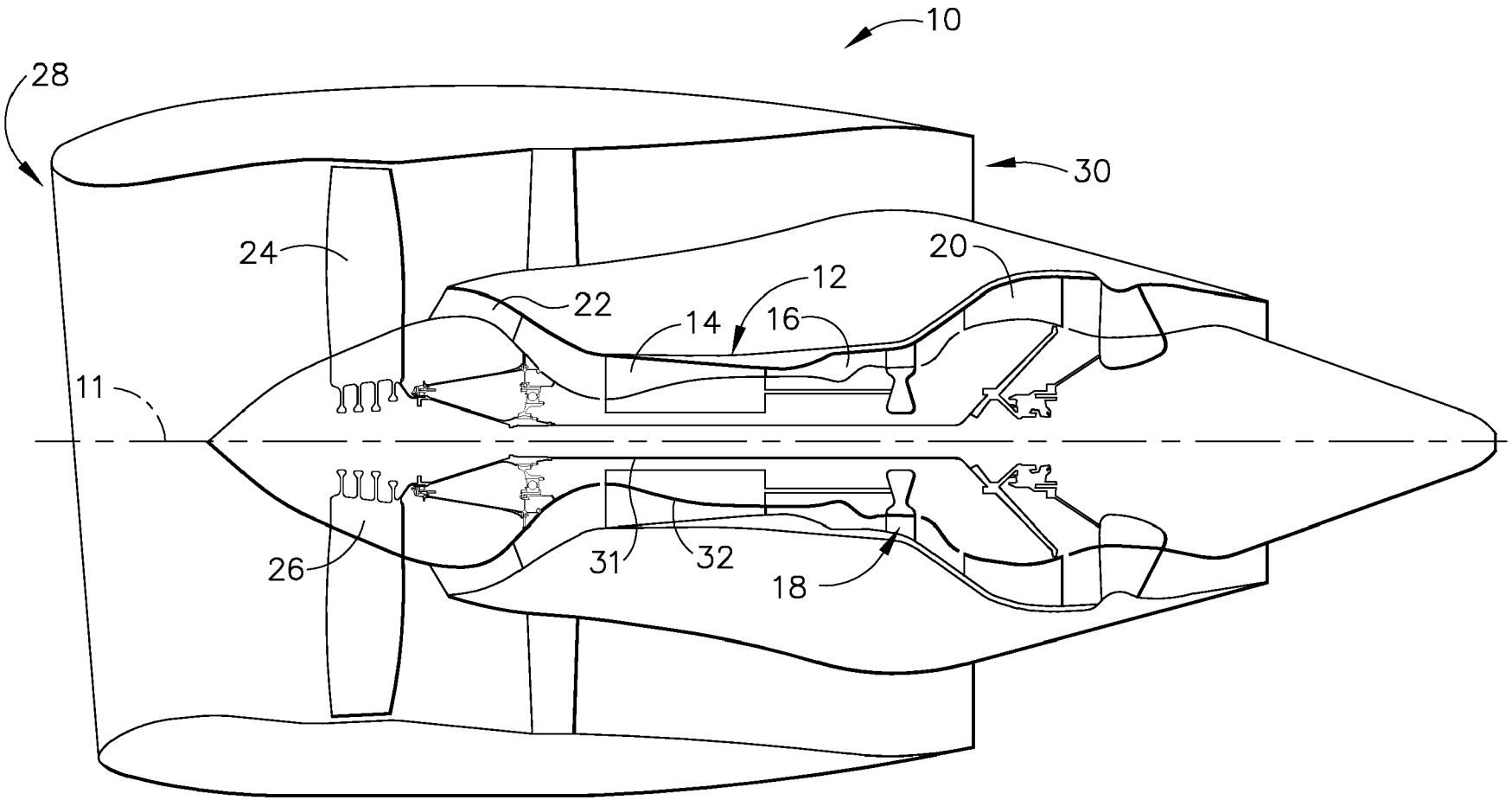
FIG. 1 is a cross-sectional view of an exemplary gas turbine engine.

FIG. 1 is a cross-sectional view of an exemplary turbofan engine assembly 10 having a longitudinal axis 11. In the exemplary embodiment, turbofan engine assembly 10 includes a core gas turbine engine 12 that includes a high-pressure compressor 14, a combustor 16, and a high-pressure turbine 18. Turbofan engine assembly 10 also includes a low-pressure turbine 20 that is coupled axially downstream from core gas turbine engine 12, and a fan assembly 22 that is coupled axially upstream from core gas turbine engine 12. Fan assembly 22 includes an array of fan blades 24 that extend radially outward from a rotor disk 26. Engine 10 has an intake side 28 and an exhaust side 30. In the exemplary embodiment, turbofan engine assembly 10 is a GE90 gas turbine engine that is available from General Electric Company, Cincinnati, Ohio. Core gas turbine engine 12, fan assembly 22, and low-pressure turbine 20 are coupled together by a first rotor shaft 31, and compressor 14 and high-pressure turbine 18 are coupled together by a second rotor shaft 32.

In operation, air flows through fan assembly blades 24 and compressed air is supplied to high pressure compressor 14. The air discharged from fan assembly 22 is channeled to compressor 14 wherein the airflow is further compressed and channeled to combustor 16. Products of combustion from combustor 16 are utilized to drive turbines 18 and 20, and turbine 20 drives fan assembly 22 via shaft 31. Engine 10 is operable at a range of operating conditions between design operating conditions and off-design operating conditions.

Figure 2:
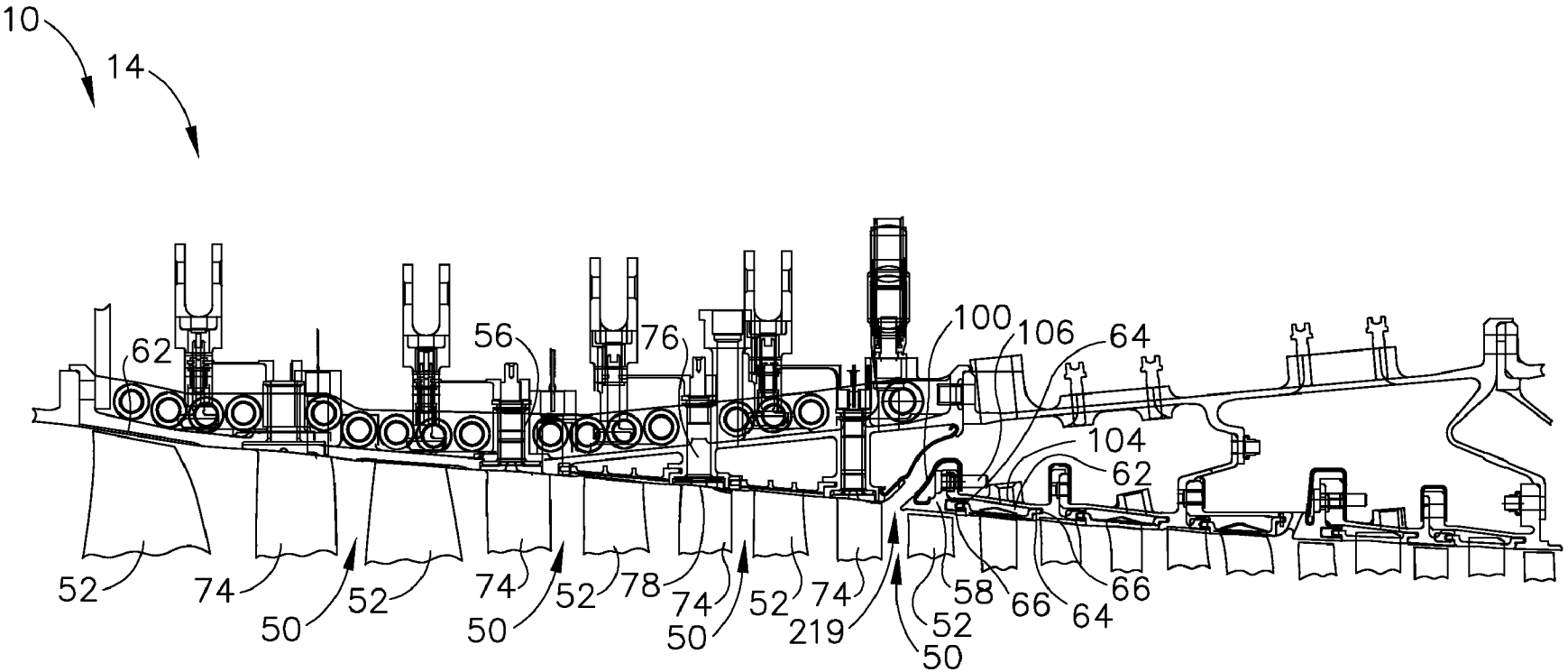
FIG. 2 is an enlarged cross-sectional view of a portion of a high pressure compressor that may be used with the gas turbine engine shown in FIG. 1.
Figure 3:
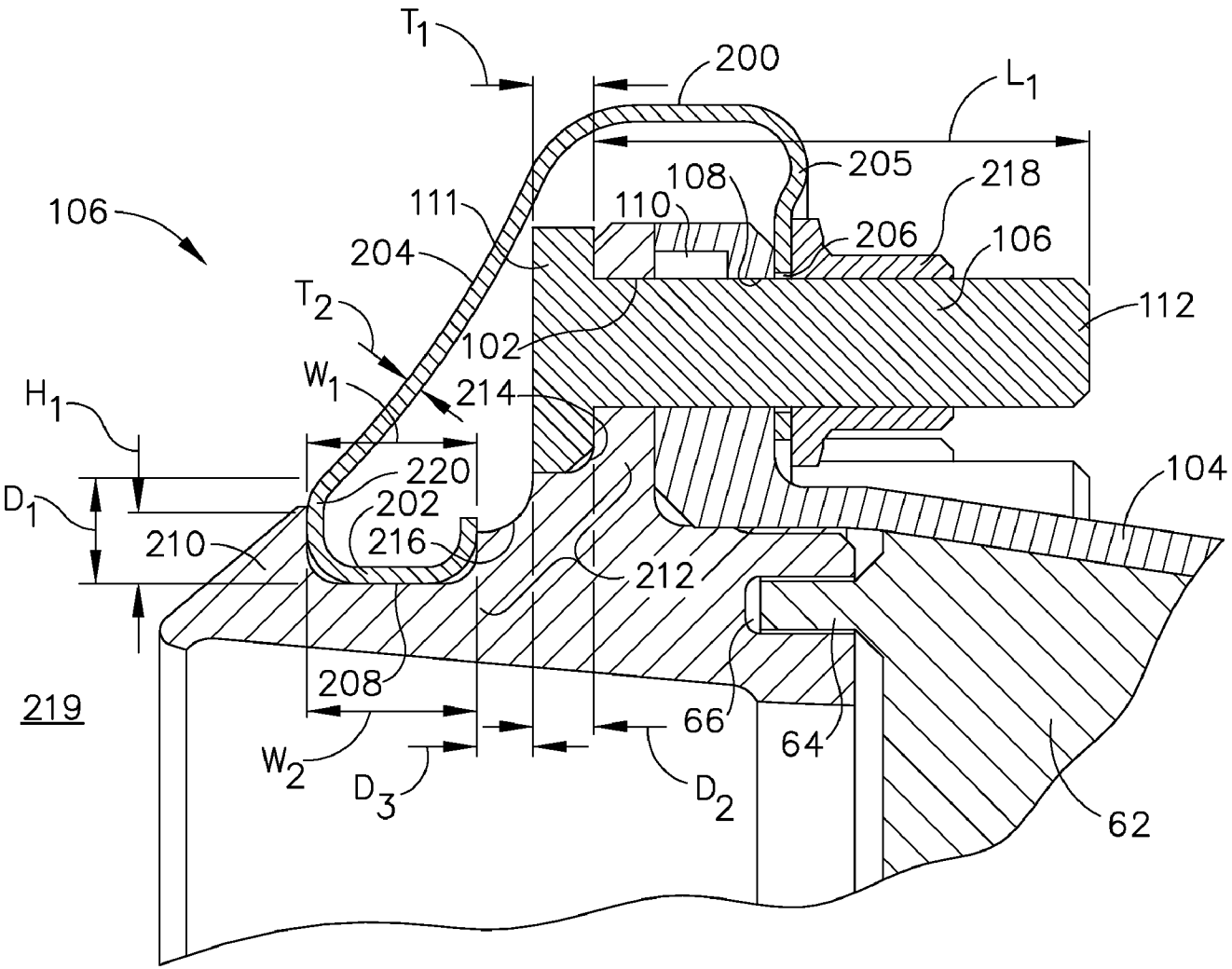
FIG. 3 is an enlarged cross-sectional view of an exemplary shield assembly coupled to a portion of the high pressure compressor shown in FIG. 2.

FIG. 2 is an enlarged cross-sectional view of a portion of high pressure compressor 14 including an exemplary shield assembly 100 coupled to a compressor stator body 58. FIG. 3 is an enlarged cross-sectional view of shield assembly 100. In the exemplary embodiment, compressor 14 includes a plurality of stages 50 wherein each stage 50 includes a row of circumferentially-spaced rotor blades 52 and a row of stator vane assemblies 56. Rotor blades 52 are typically supported by rotor disks 26, and are coupled to rotor shaft 32. Compressor 14 is surrounded by a casing 62 that supports stator vane assemblies 56. Casing 62 forms a portion of a compressor flow path extending through compressor 14. Casing 62 has rails 64 extending axially upstream and downstream of casing 62. To create a continuous compressor flow path, rails 64 are coupled to slots 66 defined in adjacent stator bodies 58, described in more detail below. Slots 66 are defined in at least one of an upstream surface and downstream surface of each stator body 58. Casing 62 is retained in position by coupling adjacent stator bodies 58 via flanges 76 and 104 and fasteners 106, as described in more detail below.

Each stator vane assembly 56 includes a vane 74, a radial flange 76, and an annular stator body 58. Each radial flange 76 extends radially outward from stator body 58. As is known in the art, vanes 74 are oriented relative to a flow path through compressor 14 to control air flow therethrough. In addition, at least some vanes 74 are coupled to an inner shroud. Alternatively, compressor 14 may include a plurality of variable stator vanes utilized in lieu of fixed stator vanes 74.

Each stator body 58 includes a radial flange 76 and an opening 102 formed therethrough. More specifically, in the exemplary embodiment, each opening 102 extends through each radial flange 76 of an upstream stator body 58. Stator body 58 may also include a stator ring or flange 104 that extends substantially axially from stator body 58. In the exemplary embodiment, stator ring or flange 104 extends generally upstream from a downstream stator body 58. More specifically, in the exemplary embodiment, each flange 104 of a downstream stator body 58 is coupled to each radial flange 76 of an adjacent upstream stator body 58 via a plurality of fasteners 106. In the exemplary embodiment, fastener 106 extends through stator body opening 102 and through an opening 108 in stator body flange 104 to secure flange 104 to an upstream stator body 58. In the exemplary embodiment, fastener 106 is a D-Head bolt that is secured in position with a breakaway nut 110. Fastener 106 has a fastener head 111 and a fastener body 112. Fastener head 111 has a thickness of $T_1$. Fastener body 112 has a length of $L_1$. In the exemplary embodiment, fastener body length $L_1$ is greater that the length of the breakaway nut 110 to allow flange 104 and a nut 218 to be coupled to fastener 106, as described in more detail below.

In the exemplary embodiment, shield assembly 100 includes a shield 200 having an integrally-formed retaining portion 202, an aerodynamically contoured upstream surface 204, and a downstream surface 205. Upstream surface 204 extends between retaining portion 202 and downstream surface 205. Downstream surface 205 includes a slot 206 extending therethrough and that is sized to receive fastener 106 therethrough, as described in more detail below. Upstream surface 204 and downstream surface 205 each have a thickness of $T_2$. Retaining portion 202 has a width of $W_1$, a depth of $D_1$, and a thickness of $T_2$. Shield 200 is arcuate with a radius $R_1$ (shown in FIG. 5) where $R_1$ is larger that the outer radius of casing 62 such that shield 200 fits circumferentially about casing 62. In the exemplary embodiment, shield assembly includes a plurality of arcuate shields 200, each with a radius of $R_1$.

In the exemplary embodiment, stator body 58 is formed with a retaining channel 208 that extends circumferentially around stator body 58 and is defined between an annular lip 210 and a stepped portion 212 of body 58. Retaining channel 208 has a width $W_2$. Lip 210 has a height of $H_1$. Channel width $W_2$ is larger than retaining portion width $W_1$ such that retaining portion 202 may be inserted in retaining channel 208. Stepped portion 212 extends outward from body 58 and, in the exemplary embodiment, is formed with a plurality of shoulders 214 and 216. Shoulder 214 is counter-bored to a depth $D_2$, where $D_2$ is substantially equal to fastener head thickness $T_1$. Shoulder 216 is counter-bored to a depth of $D_3$. When assembled, fastener head 111 is substantially flush with the outer edge of shoulder 214. In the exemplary embodiment, when retaining portion 202 is positioned in retaining channel 208, a portion of retaining portion 202 extends beyond shoulder 216.

In the exemplary embodiment, shield assembly 100 is positioned just downstream of an annular opening 219 in casing 62 and covers stator body opening 102, fastener 106, and flange 104. Shield 200 is retained in position by inserting shield retaining portion 202 into retaining channel 208. Lip 210 contacts shield 200 approximately at a point 220 where upstream surface 204 is coupled to retaining portion 202. In the exemplary embodiment, lip 210 and upstream surface 204 form a continuous contour from stator body 58 at opening 219 to downstream surface 205. Furthermore, in the exemplary embodiment, shield 200 is further secured by coupling shield 200 at slot 206 to flange 104 and breakaway nut 110 by utilizing shield slot 206. Shield 200 is secured in position by coupling nut 218 to fastener body 112 downstream of breakaway nut 110, slot 206, and flange opening 108. When shield assembly 100 is secured in position over stator body 58, shield assembly 100 creates an aerodynamic surface between stator body 58 and the airflow.

Figure 4:
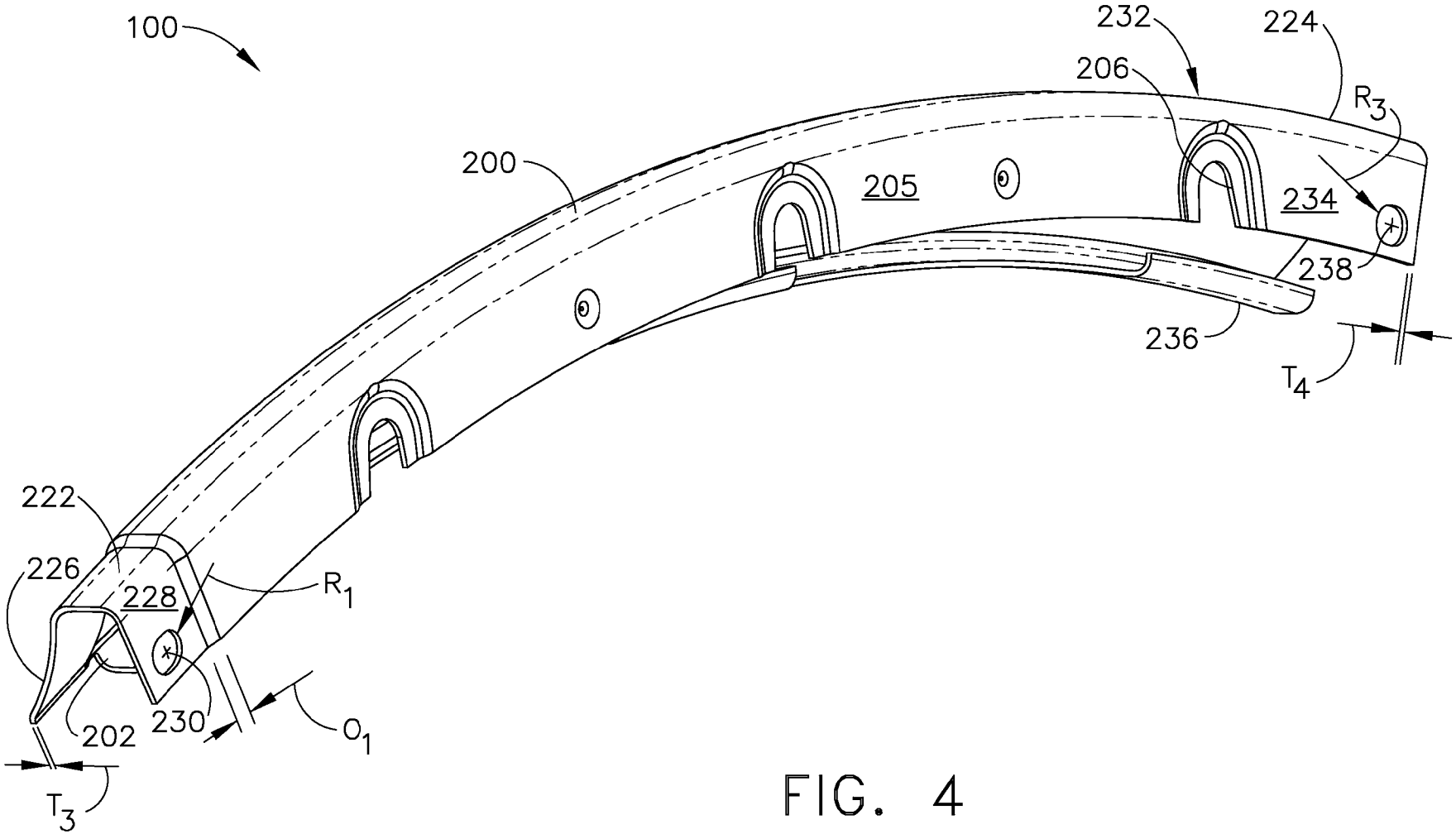
FIG. 4 is a perspective view of the shield assembly shown in FIG. 3.
Figure 5:
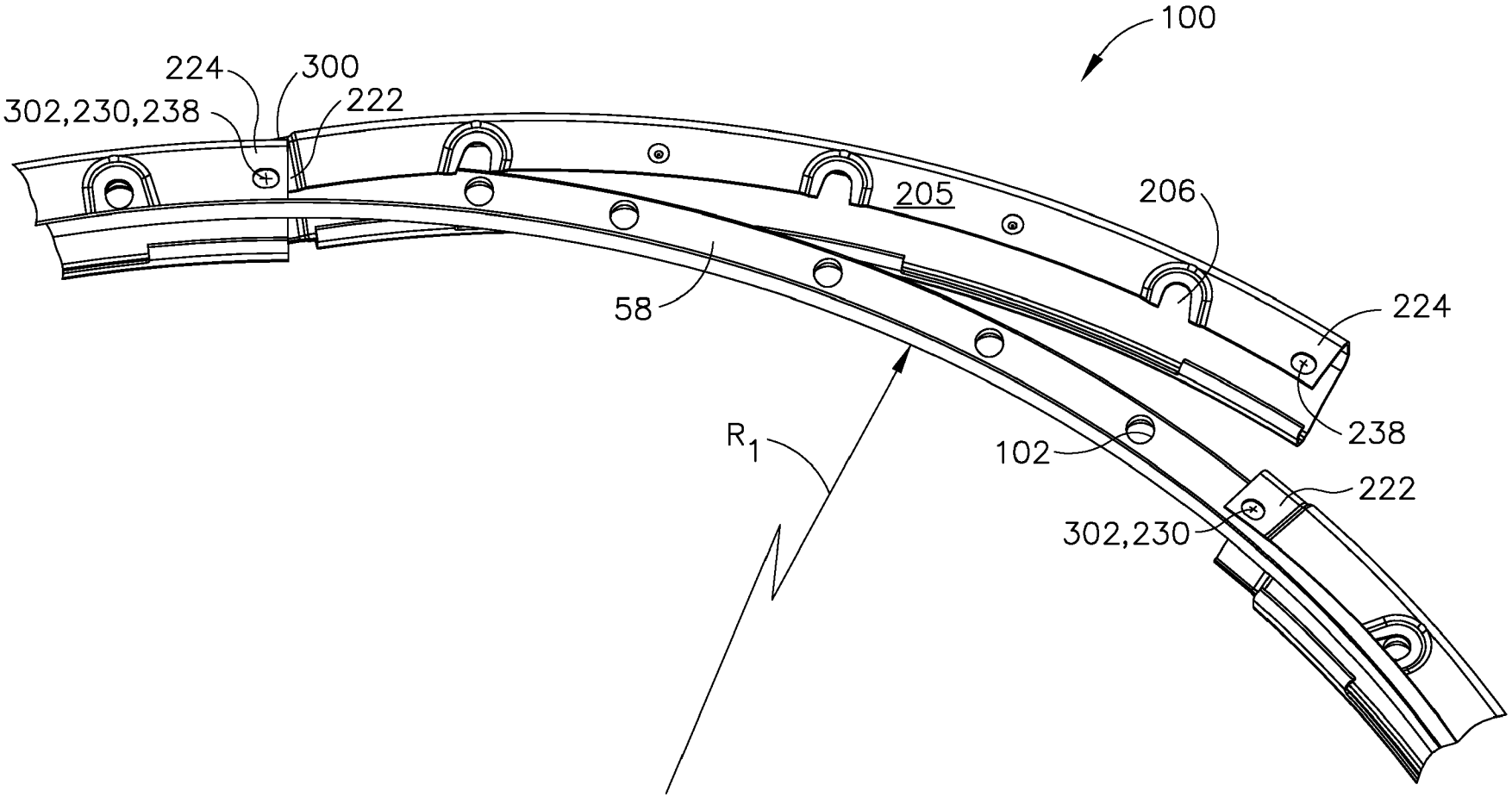
FIG. 5 is an exploded view of the shield assembly shown in FIG. 4.
Figure 6:
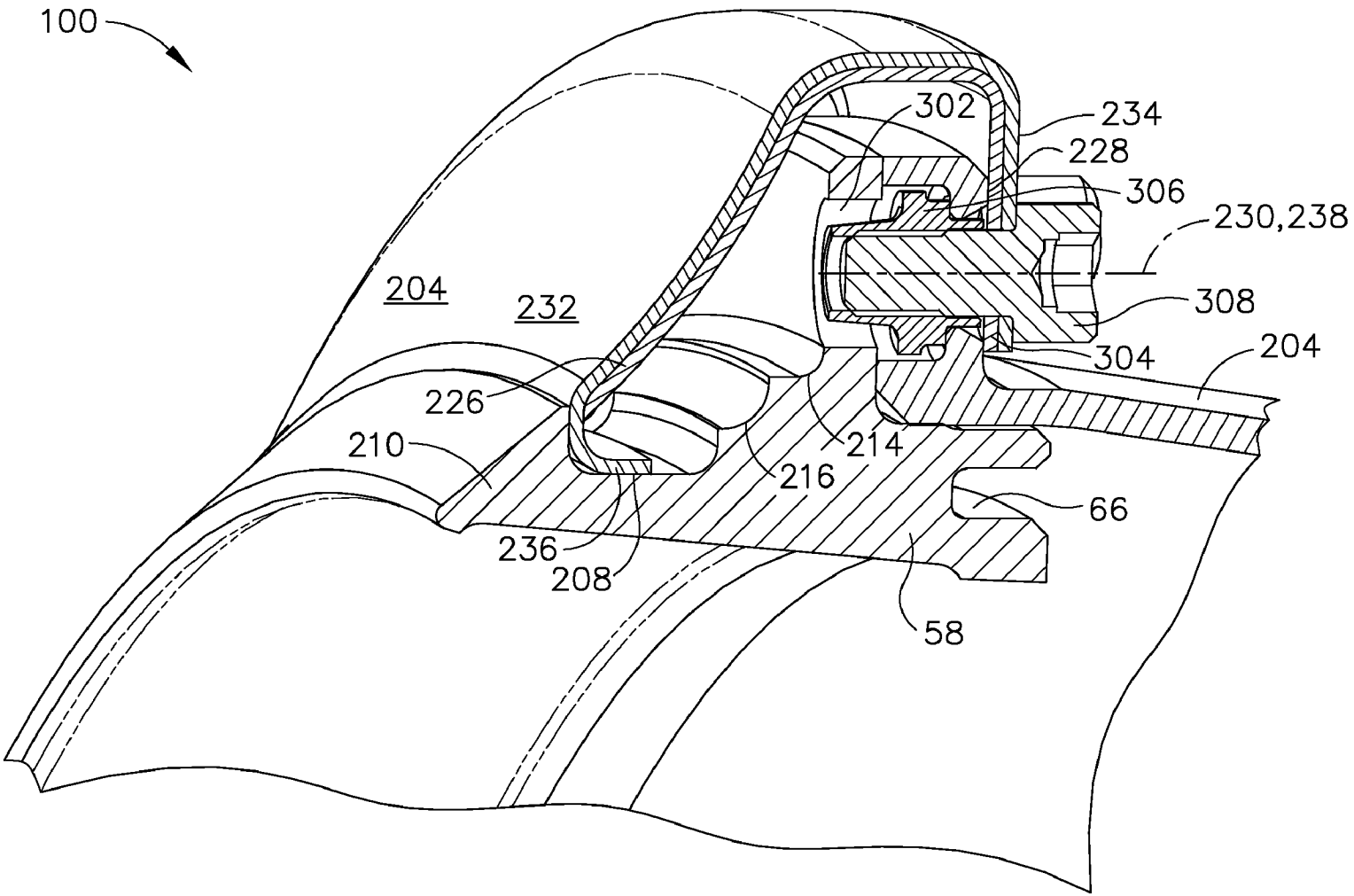
FIG. 6 is a second enlarged cross-sectional view of the shield assembly shown in FIG. 3.

FIG. 4 is a perspective view of an exemplary shield assembly 100 including shield 200. FIG. 5 is an exploded view of an exemplary shield assembly 100 coupled to stator body 58. FIG. 6 is a second enlarged cross-sectional view of an exemplary shield assembly 100 coupled to stator body 58 at an overlap engagement 300. In the exemplary embodiment, shield assembly 100 includes a first overlap portion 222 and a second overlap portion 224 coupled to shield 200.

In the exemplary embodiment, first overlap portion 222 is recessed from shield 200 by offset $O_1$. More specifically, in the exemplary embodiment, offset $O_1$ is substantially equal to shield thickness $T_2$. First overlap portion 222 has an upstream surface 226 and a downstream surface 228. Upstream surface 226 and downstream surface 228 each have a thickness of $T_3$. In the exemplary embodiment, thickness $T_3$ is substantially equal to shield thickness $T_2$. Upstream surface 226 is aerodynamically contoured and has a contour substantially equal to that of upstream surface 204. An aperture 230 having a radius $R_2$ extends through downstream surface 228.

In the exemplary embodiment second overlap portion 224 is co-planar with shield 200. Second overlap portion has an upstream surface 232, a downstream surface 234, and a retaining portion 236. Upstream surface 232 and downstream surface 234 each have a thickness $T_4$. In the exemplary embodiment, thickness $T_4$ is equal to thickness $T_2$. Upstream surface 232 is configured to have substantially the same aerodynamic contour as upstream surface 204. Retaining portion 236 is configured to have the same features and dimensions as retaining portion 202, described above. Downstream surface 234 has an aperture 238 extending therethrough. More specifically, in the exemplary embodiment, aperture 238 has a radius $R_3$ that is equal to aperture radius $R_2$.

In the exemplary embodiment, first overlap portion 222 is inserted between second overlap portion 224 of an adjacent shield 200 and stator body 58. First overlap portion 222 and second overlap portion 224 are configured to mate and form overlap engagement 300. Aperture 230 is configured to align with aperture 238 of adjacent second overlap portion 224. Apertures 230 and 238 are further configured to align with a second opening 302 extending through stator body 58. Moreover, in the exemplary embodiment, flange 104 has a second opening 304 extending therethrough. Flange second opening 304 is sized to receive a retainer 306. More specifically, second opening 302 has a radius $R_4$ where $R_4$ is greater than $R_2$ and/or $R_3$ such that radius $R_4$ is sized to receive retainer 306. Furthermore, in the exemplary embodiment, retainer 306 is a shank nut. Retainer 306 is positioned within stator body second opening 302 and flange second opening 304. Apertures 230 and 238 are configured to align with retainer 306 positioned in openings 302 and 304. Overlap portions 222 and 224 are secured to stator body by inserting a second fastener 308 through apertures 230, 238 and into retainer 306. More specifically, in the exemplary embodiment, second fastener 308 is a traditional bolt. In the exemplary embodiment, when apertures 230 and 238 are coupled to retainer 306, shield slot 206 is aligned with stator body opening 102.

While engine 10 is in operation, shield assembly 100 facilitates reducing aerodynamic bleed losses by providing an aerodynamic surface over which air may flow and experience a pressure recovery. Further, stator body 58, stator body flange 104, and fastener 106 assembly is shielded from airflow of heated fluids. When in position, shield assembly 100 facilitates reducing the thermal expansion of stator body 58, which thereby facilitates slowing the growth of the stator during transient conditions and reducing tip clearances. When first overlap portion 222 and second overlap portion 224 form overlap engagement 300, overlap engagement 300 facilitates reducing leakage of air between shields 200 of shield assembly 100 and reduces aerodynamic windage losses over the shield.

The above-described apparatus facilitates reducing losses in a compressor. The shield assembly facilitates minimizing losses by creating an aerodynamic surface in the air flow path and aiding in pressure recovery. In the exemplary embodiment, a secondary air flow bled from the main compressor airflow flows over the aerodynamic surface. The airflow across the stator body increases in temperature of the stator body because of friction between the fluid and the surface of the stator body (windage). By coupling the shield assembly upstream of the stator body, the fluid has an aerodynamic surface across which to flow, reducing friction between the fluid and the stator body. The reduction in windage maintains the secondary air flow at a lower temperature than in other known compressors. Furthermore, since the bleed air flows over the shield and does not directly impinge on the stator ring, the stator ring is shielded from the convection air flow. The overlapping shields create a low convection cavity around the stator ring such that the shield facilitates insulating the stator ring from the air flow. Therefore, the shield assembly also facilitates maintaining the desired stator thermal-displacement response to passively control the clearance between the rotating tip and the stationary inner surface of the compressor flow path. Because of the insulation effects of the shield assembly, the mass of the fastener at the stator body joints can be reduced while achieving the same time constant as a fastener with more mass.

Exemplary embodiments of a method and apparatus to facilitate reducing losses in a compressor are described above in detail. The method and apparatus is not limited to the specific embodiments described herein, but rather, components of the method and apparatus may be utilized independently and separately from other components described herein. For example, the shield assembly may also be used in combination with other turbine engine components, and is not limited to practice with only stator body assemblies as described herein. Rather, the present invention can be implemented and utilized in connection with many other windage loss reduction applications.

While the invention has been described in terms of various specific embodiments, those skilled in the art will recognize that the invention can be practiced with modification within the spirit and scope of the claims.

What is claimed is:

1. A method for assembling a compressor for use with a turbine, said method comprising:

coupling at least a first stator ring to a second stator ring via at least one fastener sized to extend through at least one stator ring opening; and coupling a shield assembly to at least one of the first stator ring and the second stator ring, wherein the shield assembly includes a downstream surface, a retaining portion, and a contoured upstream surface extending from the downstream surface to the retaining portion, wherein said coupling comprises:

coupling a first arcuate member to the at least one stator ring opening, wherein the first arcuate member includes at least one retaining slot defined therein;

coupling a second arcuate member to at least one retainer, wherein the second arcuate member includes an aperture extending therethrough; and coupling the first arcuate member and the second arcuate member together.

2. A method in accordance with claim 1 further comprises inserting the at least one retaining portion of the shield assembly within a groove defined in at least one of the first stator ring and the second stator ring such that the shield assembly substantially shields at least one stator ring from air flowing past at least one stator ring.

3. A method in accordance with claim 1 wherein coupling a shield assembly to at least one of a first stator ring and a second stator ring further comprises coupling the shield assembly to the stator ring to facilitate reducing aerodynamic bleed losses of the stator ring.

4. A method in accordance with claim 1 wherein coupling a shield assembly to at least one of a first stator ring and a second stator ring comprises:

providing a plurality of shield segments that each have a first arcuate member, a second arcuate member, and a body extending therebetween;

coupling the first arcuate member of a first shield segment and the second arcuate member of second shield segment together such that fluid leakage between the first and second shield segments is facilitated to be reduced.

5. A method in accordance with claim 1 wherein coupling the first arcuate member to the at least one stator ring opening further comprises coupling the at least one retaining slot to the at least one stator ring opening by securing the at least one retaining slot in position with at least one nut coupled to the at least one fastener.

6. A method in accordance with claim 1 wherein coupling the second arcuate member to at least one retainer further comprises securing the shield assembly second arcuate portion in position with respect to the at least one of the first stator ring and the second stator ring by positioning the at least one retainer in at least one stator ring and extending a pin through the at least one retainer.

7. A turbine assembly comprising:

a compressor assembly with at least one flange coupled to at least one stator ring via at least one fastener sized to extend through at least one stator ring opening; and a shield assembly coupled to said at least one stator ring, wherein said shield assembly comprises a downstream surface, a retaining portion, and a contoured upstream surface extending from said downstream surface to said retaining portion, wherein said shield assembly comprises a first arcuate member and a second arcuate member coupled together, wherein said first arcuate member comprises at least one retaining slot defined therein, wherein said second arcuate member further comprises an aperture extending therethrough, wherein said first arcuate member is coupled to said at least one stator ring opening, and wherein said second arcuate member is coupled to at least one retainer extending through said at least one stator ring.

8. A turbine assembly in accordance with claim 7 wherein said shield assembly retaining portion is inserted within a groove defined in the at least one stator ring such that said shield assembly substantially shields said at least one stator ring from air flowing past said at least one stator ring.

9. A turbine assembly in accordance with claim 7 wherein said at least one flange is coupled to said at least one stator ring such the said flange extends downstream from said stator ring, and said shield assembly is coupled to said at least one stator ring to facilitate reducing windage losses of said at least one stator ring.

10. A turbine assembly in accordance with claim 7 wherein said shield assembly retaining slot is coupled to said at least one stator ring opening, wherein said retaining slot is secured in position with at least one nut coupled to said at least one fastener.

11. A turbine assembly in accordance with claim 7 wherein said shield assembly further comprises of a plurality of shield segments, wherein each shield segment comprises a first arcuate member, a second arcuate member, and a body extending therebetween, wherein said first arcuate member of a first shield segment is coupled to said second arcuate member of a second shield segment such that fluid leakage between said first shield segment and said second shield segment is facilitated to be reduced.

12. A compressor assembly for use with a turbine, said compressor assembly comprising:

at least one flange coupled to at least one stator ring via at least one fastener sized to extend through at least one stator ring opening; and a shield assembly coupled to said at least one stator ring, said shield assembly comprises a downstream surface, a retaining portion, and a contoured upstream surface extending from said downstream surface to said retaining portion, wherein said shield assembly further comprises a first arcuate member and a second arcuate member coupled together, wherein said first arcuate member comprises at least one retaining slot defined therein, wherein said second arcuate member further comprises an aperture extending therethrough, wherein said first arcuate member is coupled to said at least one stator ring opening, and wherein said second arcuate member is coupled to at least one retainer extending through said at least one stator ring.

13. A compressor assembly in accordance with claim 12, said shield assembly retaining portion is inserted within a groove defined in said at least one stator ring such that said shield assembly substantially shields said at least one stator ring from air flowing past said at least one stator ring.

14. A compressor assembly in accordance with claim 12 wherein said at least one flange is coupled to said at least one stator ring such that said flange extends downstream from said stator ring, and said shield assembly is coupled to said at least one stator ring to facilitate reducing windage losses of said at least one stator ring.

15. A compressor assembly in accordance with claim 12 wherein said shield assembly further comprises of a plurality of shield segments, wherein each shield segment comprises a first arcuate member, a second arcuate member, and a body extending therebetween, wherein said first arcuate member of a first shield segment couples to said second arcuate member of a second shield segment such that fluid leakage between said first shield segment and said second shield segment is facilitated to be reduced.

16. A compressor assembly in accordance with claim 12 wherein said shield assembly retaining slot is coupled to said at least one stator ring opening, wherein said retaining slot is secured in position with at least one nut coupled to said at least one fastener.

17. A compressor assembly in accordance with claim 12 wherein said shield assembly second arcuate portion is retained in position with respect to said at least one stator ring via said at least one retainer extending through said at least one stator ring and a pin extending through said at least one retainer.

* * * * *